United States Patent [19]

Timms

[11] 4,415,517

[45] Nov. 15, 1983

[54] METHOD AND APPARATUS FOR SHAPING FIBER MATS

[75] Inventor: Donny L. Timms, Cleburne, Tex.

[73] Assignee: Manville Service Corporation, Denver, Colo.

[21] Appl. No.: 288,964

[22] Filed: Jul. 31, 1981

[51] Int. Cl.[3] ..... D04H 1/16; B28B 7/14

[52] U.S. Cl. ..... 264/118; 264/119; 264/120; 425/296; 425/297; 425/302.1; 425/305.1; 425/313; 425/314; 425/315; 425/316; 425/367; 425/404; 425/309; 425/306; 425/328

[58] Field of Search ..... 264/118, 119, 120; 425/296, 297, 302.1, 305.1, 313–316, 367, 404, 309, 328

[56] References Cited

U.S. PATENT DOCUMENTS

| | | | |
|---|---|---|---|
| 2,989,774 | 6/1961 | Erickson et al. | 264/118 |
| 3,518,157 | 6/1970 | Terry et al. | 264/119 |
| 3,608,025 | 9/1971 | Mirsky | 264/147 |
| 3,661,491 | 5/1972 | Troyer | 425/306 |
| 4,174,416 | 11/1979 | Marcer | 264/167 |

*Primary Examiner*—H. S. Cockeram

*Attorney, Agent, or Firm*—Ronald M. Halvorsen; John D. Lister; Richard K. Thomson

[57] ABSTRACT

Method and apparatus for shaping of mats composed of loose fibers with a thermosetting resin interspersed throughout. The apparatus compresses the mat and exposes its laterally extending surfaces to elevated temperatures to obtain partial curing thereof. Slits are made in the surface regions adjacent areas where extra shaping will occur in forming the final product. These slits enable more precise shapes to be impressed upon the mat and eliminate the tendency of the partially cured areas to spring back to a position of lesser compression.

10 Claims, 5 Drawing Figures

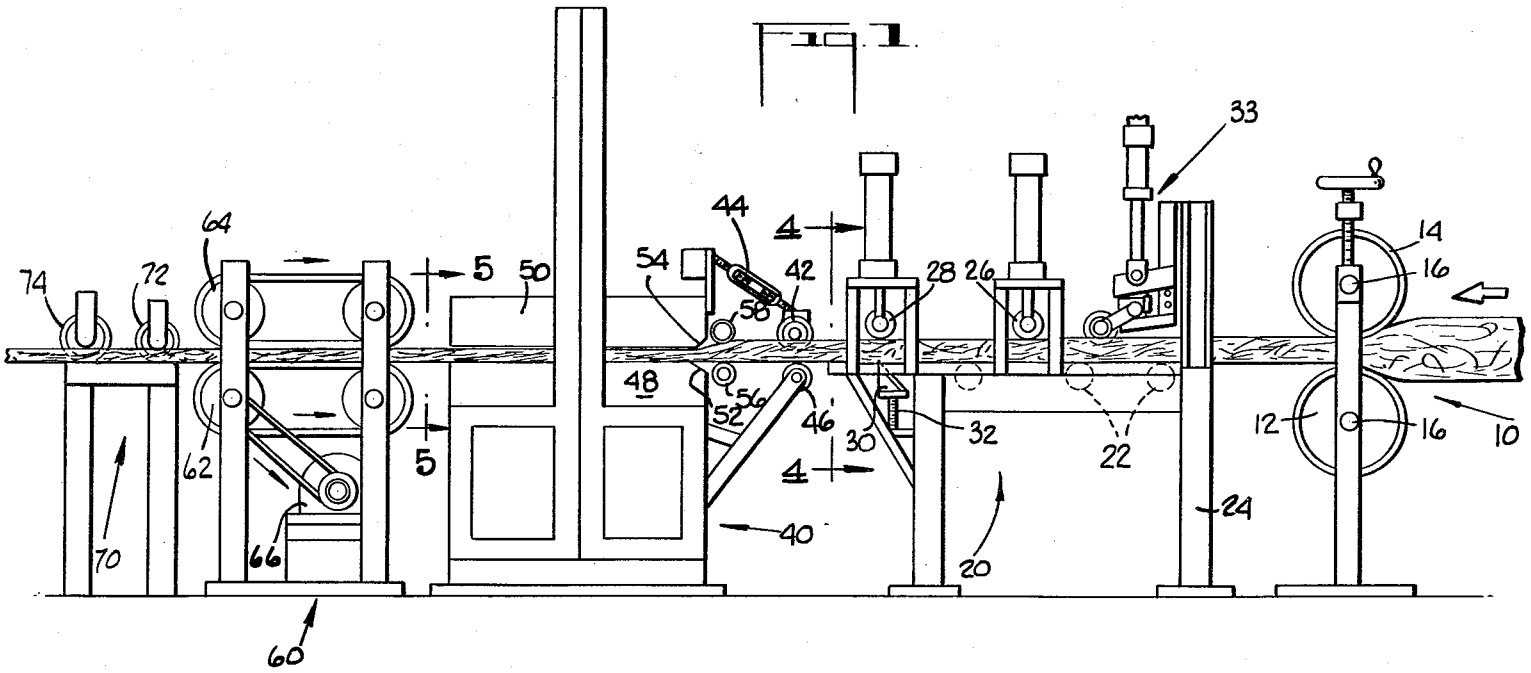
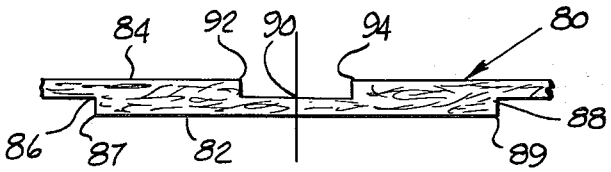
FIG. 5
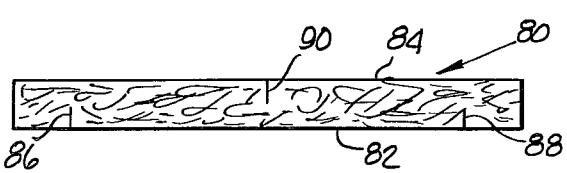
FIG. 4

METHOD AND APPARATUS FOR SHAPING FIBER MATS

TECHNICAL FIELD

This invention relates to a method and apparatus for forming and shaping uncured fiber mats composed of loose fibers with a thermosetting binder distributed throughout the mat.

BACKGROUND AND SUMMARY OF THE INVENTION

The present invention is related to the method and apparatus described and claimed in U.S. Pat. Nos. 3,518,157 and 3,583,030, respectively, to Terry et al. More particularly, the present invention is directed at solving some problems which have resulted in one of the products manufactured using the aforesaid method and apparatus.

In each of the Terry et al patents, FIG. 10 depicts a fiber duct board in which the edge portions are compressed more than the remainder of the board. These edges, then, have a greater density and define a shoulder which provides a reference surface for overlapping or abutting multiple widths of the board to form a rectangular duct. The greater edge density strengthens the ultimate duct in the vicinity of the longitudinal joints.

In order to manipulate the fiber mats of the Terry et al. patents, it is necessary to partially cure the thermosetting binder in the vicinity of the two laterally extending surfaces. This makes the mat easier to handle by giving it definition and enables it to be further formed and shaped more easily. The difficulty arises specifically with the mat configuration which has the compressed edges. The partial cure causes the fibers on the surface to adhere to one another. When the edges of the partially cured mat are compressed more than the remainder, the adhering fibers are stretched. Once the compression is released, there is a tendency of these stretched fibers to spring back to a lesser compression. The shoulders on the fiber board become rounded as the fibers return to a position of lesser compression. In the assembled duct, these rounded shoulders produce line, rather than surface, contact at the joints. Such line contact can enable these joints to slip and can produce inadequate sealing resulting in leakage.

The present method and apparatus remedy this spring back problem. Following the initial curing of the laterally extending faces of the mat, longitudinal slits are formed adjacent the regions where the largest amounts of compression will occur. These slits are deep enough to penetrate through the partial cure on the surfaces of the mat to the uncured fibers beneath. The regions which are to be more compressed than the remainder of the mat can then be formed and shaped without suffering the tendency to spring back which was experienced in previous manufacturing efforts. These and other characteristics, features, and advantages of the present invention will become more apparent after a reading of the following descrptiion.

BRIEF DESCRIPTION OF THE DRAWING

FIG. 1 is a schematic side view of the apparatus of the present invention;

FIG. 4 is a cross-sectional view of the mat as it exits the slitting unit with the position of the slits indicated thereon; and FIG. 5 is a cross-sectional view of the formed fiber mat as it appears following exit from the shaping platens.

DETAILED DESCRIPTION OF THE PREFERRED EMBODIMENTS

Figure 3:
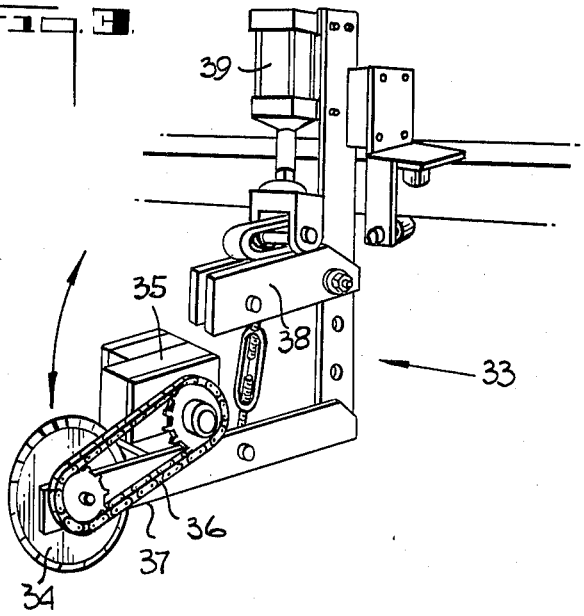
FIG. 3 is an enlarged perspective of a power driven rotary blade used to slit the upper laterally extending surface of the fiber mat.

As depicted in FIG. 1, the apparatus of the present invention consists of five components: the searing roll unit 10, the slitter unit 20, the shaper platen unit 40, the mat-pulling unit 60 and the trim unit 70. While units 10, 40 and 60 will be described briefly here in order to facilitate understanding, these units are, for the most part, identical to the apparatus described in U.S. Pat. No. 3,518,157 which is incorporated herein, in pertinent part, by reference.

Unit 10 has a pair of searing rolls 12 and 14. Lower roll 12 is fixedly mounted while the vertical position of upper roll 14 may be adjusted in order to vary the amount of compression the fibrous mat is exposed to. The mat is preferably a mat of loose glass fibers with a thermosetting binder uniformly interspersed therein. Each roll 12 and 14 has a heating unit 16, here shown as gas burners. Clearly, other forms of heating units such as electric induction heaters, could also be used. These searing rolls 12 and 14 compress the mat of loose fibers substantially along the entirety of both laterally extending surfaces to approximately one half of its original thickness. At the same time, the heated rolls give a partial cure to the thermosetting resin thereby giving the mat definition. This partial curing of the laterally extending surfaces gives the mat a certain integrity enabling it to be handled and shaped more easily.

As previously noted, however, the partial cure also creates a problem in mat configurations where certain portions need to be compressed more than the remainder of the mat. The partially cured region contains fibers which adhere to one another. When compressed by the shaper platens, the fiber-binder surface regions adjacent the compressed area stretch. When the compression is released, the fibers spring back, returning to a less compressed condition. This results in "rounded shoulders" on the fiber board which can have detrimental effects when the board is used.

Unit 20 and some elements added to unit 40 are intended to resolve this spring-back problem. Unit 20 has a plurality of support rollers 22 which are journaled in frame 24 for free rotation so as to minimize resistance to the passage of the mat. A pair of hold-down rollers 26 and 28 prevent upward movement by the mat as will be detailed hereinafter.

Figure 2:
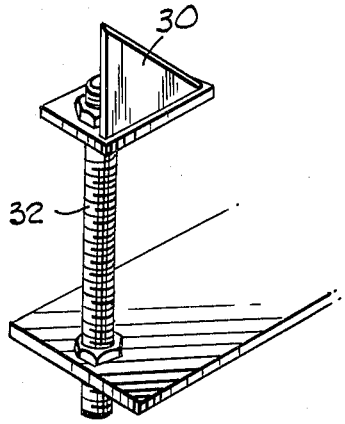
FIG. 2 is an enlarged perspective of one knife edge used in slitting the lower laterally extending surface of the fiber mat.

A pair of triangularly shaped blades 30 (one of which is shown in detail in FIG. 2) are positioned generally beneath the horizontal centerline of the mat at points spaced inwardly from the mat edges some three to four inches (7.7 to 10.3 centimeters). Threaded rod 32 permits the depth of penetration of the mat to be adjusted; preferably this depth is sufficient to penetrate the "skin" formed by the partial cure administered by the searing rolls. As the mat passes blades 30, two longitudinal slits are made in one of the laterally extending surfaces (82) of the mat. Hold-down rollers 26 and 28 prevent the mat from merely raising up as it passes above blades 30, rather than being slit.

Another slitting device, shown generally at 33 is mounted above the horizontal centerline of the mat as it passes through unit 20. Unlike the outside or male shoulders, where both ends of the material to undergo extra compression are free, one end of each of the fibers in the two center-region or female shoulders remains connected after slitting. For this reason, the center slit must be deeper than the edge-region slits in order to provide a similar degree of freedom for these fibers. It has been found that if this deeper slit were to be made by a single cutting means, the partially cured surface layer would crack creating wrinkles on one or both of the female shoulders. Since no material is trimmed from these edges (as there is from the outer edges), such wrinkling in the edges is unacceptable.

Applicant has discovered that if the center slit is formed in a plurality of steps, such wrinkling is avoided. Therefore, slitting device 33 has a rotatably mounted blade 34 which slits the surface 84 at a first lateral position to a first predetermined depth. In order to insure that the surface is in fact cut and not merely creased, blade 34 is rotationally driven by, for example, electric motor 35 by means of transmission chain 36. Blade 34 is rotatably mounted on arm 37 which is connected to linkage 38. Linkage 38 and, hence, blade 34 may be vertically positioned by air cylinder 39 to vary the depth of penetration into the laterally extending surface of the partially cured mat.

A second cutting blade 42 is mounted on the front of platen unit 40. Unlike its counterpart, however, blade 42 is rotationally locked in position to provide a slicing action to the mat as it passes. The blade may be adjusted by means of turnbuckle 44. Directly beneath blade 42 is a journaled support roller 46 which insures cutting rather than deflecting of the mat.

Unit 40 primarily consists of upper and lower platens 50 and 48. These platens have generally uniform cross sections which conform to the desired final configuration of the lower and upper laterally extending mat surfaces 82 and 84 (FIG. 5). Platens 48 and 50 have tapered infeed sections 52 and 54 to facilitate mat entry. In addition, rollers 56 and 58 which are positioned adjacent the entry to the platens, further compress the fibers in the mat from the dimension they had when exiting from the searing roll unit 10.

Mat-pulling unit 60 comprises first and second endless belts 62 and 64, at least one of which is driven by motor 66. Lower belt 62 is mounted in a fixed vertical position while belt 64 may be adjusted vertically to vary the amount of pulling force applied to the mat 80.

Trim unit 70 has three blades. Two blades 72 (one of which is shown) are positioned two to three inches (5 to 8 centimeters) inwardly from the lateral edges of the mat and rotate generally about a common axis. These outer edges of the mat are trimmed in order to insure a uniform thickness and density to the edge regions of the final product. The third blade 74 slices the board in half generally at the same lateral position as the slit formed by blades 34 and 42. This edge need not be trimmed since the variations in thickness and density do not occur in the center of the mat as they do along the edges.

In operation, mat 80 is pulled through searing rolls 12 and 14 and, through the other units as well, by unit 60. The mat is compressed from its original thickness and the laterally extending surfaces 82 and 84 exposed to heat to partially cure the thermosetting binder in the surface region to produce a skin layer which facilitates handling. Slitter blades 30 then produce two slits 86 and 88 on the lower surface adjacent the point where shoulders 87 and 89 are to be formed. Power driven blade 34 forms a slit 90 in the upper surface intermediate where shoulders 92 and 94 will be formed. Blade 42 deepens slit 90 in surface 84. The mat then passes between compression rollers 56 and 58 as it is fed between platens 48 and 50. The platens are shaped to compress the edges and center region to a thickness which is about one half of the remaining board thickness. Downstream of the pulling unit 60, two blades 72 trim the edges and blade 74 severs the board into two running lengths.

The present invention remedies a significant problem which has been experienced in manufacturing a specific duct board product. With this process and apparatus, a better quality product having square shoulders can be manufactured.

Various changes, alternatives and modifications will become apparent to those of ordinary skill in the art following a reading of the foregoing specification. It is intended that all such changes, alternatives and modifications as come within the scope of the appended claims be considered part of the present invention.

I claim:

1. A method of forming an uncured fibrous mat which contains a thermosetting binder throughout into a desired shape, said mat having upper and lower face surfaces and intermediate edge surfaces, said method comprising the steps of:

(a) subjecting the uncured mat of loose fibers to a first compressive force substantially along the entirety of both said upper and lower face surfaces while applying heat to said face surfaces to partially cure said thermosetting binder in the region of said face surfaces producing a mat of generally uniform cross section;

(b) longitudinally slitting at least one of said partially cured face surfaces to cut fibers in said partially cured mat which extend generally transverse to said mat and to said slit;

(c) subjecting the partially cured mat to a second compressive force substantially along the entirety of both said upper and lower face surfaces while applying additional heat to complete curing of the binder to complete the forming of said mat into the desired shape, said second compressive force having a greater magnitude in the vicinity of said at least one slit to reduce the mat thickness a greater amount in that region providing the mat with a nonuniform cross section, said slit eliminating the adherence of the surface fibers caused by the partial cure, thereby reducing the tendency of the mat to return to said uniform cross section.

2. The method of claim 1 wherein said slitting step includes forming two longitudinal slits in one of said upper and lower face surfaces and a single longitudinal slit in the opposite face surface.

3. The method of claim 2 wherein the formation of the single slit in said opposite face surface is performed in a plurality of operations.

4. The method of claim 2 further comprising the step of parting the mat along the single slit in the opposite face surface to form two separate strips.

5. The method of claim 1 wherein steps (a), (b) and (c) are performed on a continuously moving mat of indeterminate length by pulling said mat through a plurality of stations.

6. Apparatus for forming and shaping an uncured fibrous mat having upper and lower face surfaces and intermediate edge surfaces, said apparatus comprising a first means to compress said upper and lower face surfaces of the uncured mat of loose fibers, which contains a thermosetting binder throughout, while simultaneously heating said face surfaces to partially cure said binder in the region of said face surfaces; slitting means to longitudinally sever at least one of said partially cured face surfaces in at least one place to cut fibers therein extending generally transverse to said mat; a second means to compress and heat said upper and lower face surfaces to complete the curing of said thermosetting binder throughout the mat, said second means compressing the mat in the vicinity of said at least one slit a greater amount, said slit reducing the tendency of said mat in its vicinity to resist the additional compression.

7. The apparatus of claim 6 wherein said slitting means comprise first and second knife-edges to produce parallel slits in one of said upper and lower face surfaces and additional means to produce a single slit in the opposite of said face surfaces.

8. The apparatus of claim 7 wherein said additional means is positioned substantially midway between said first and second knife-edges.

9. The apparatus of claim 7 wherein said additional means comprise first and second rotary blades, said first rotary blade severing the partially cured face surface at a first lateral position to a first depth and said second rotary blade severing the partially cured face surface at said same lateral position to a second greater depth.

10. The apparatus of claim 6 further comprising means to pull the fibrous mat through said first and second compressing and heating means, said pulling means being positioned downstream of said second such means so as to engage and pull the mat at a point where said laterally extending surfaces are fully cured.

* * * * *